US005760658A

United States Patent [19]

Tokuda et al.

[11] Patent Number: 5,760,658

[45] Date of Patent: Jun. 2, 1998

[54] CIRCULAR-LINEAR POLARIZER INCLUDING FLAT AND CURVED PORTIONS

[75] Inventors: Katsuhiko Tokuda, Osaka; Yoshikazu Yoshimura, Takatsuki, both of Japan

[73] Assignee: Matsushita Electric Industrial Co., Ltd., Osaka, Japan

[21] Appl. No.: 298,763

[22] Filed: Aug. 31, 1994

[30] Foreign Application Priority Data

Sep. 3, 1993 [JP] Japan ..... 5-219616

[51] Int. Cl.[6] ..... H01P 1/17

[52] U.S. Cl. ..... 333/21 A; 333/157

[58] Field of Search ..... 333/21 A, 157

[56] References Cited

U.S. PATENT DOCUMENTS

| | | | |
|---|---|---|---|
| 2,546,840 | 3/1951 | Tyrrell | 333/159 |
| 2,599,753 | 10/1952 | Fox | 333/21 A |
| 2,701,344 | 2/1955 | Bowen | 333/157 |
| 2,741,744 | 4/1956 | Driscoll | 333/21 A |
| 2,858,512 | 10/1958 | Barnett | 333/21 A X |
| 2,961,618 | 11/1960 | Ohm | 333/137 |
| 3,577,105 | 5/1971 | Jones, Jr. | 333/35 X |
| 4,195,270 | 3/1980 | Rainwater | 333/211 T |
| 4,353,041 | 10/1982 | Bryans et al. | 333/21 A |

FOREIGN PATENT DOCUMENTS

| | | | |
|---|---|---|---|
| 51-117854 | 10/1976 | Japan . | |
| 56-17501 | 2/1981 | Japan . | |
| 59-108302 | 7/1984 | Japan . | |
| 60-14501 | 1/1985 | Japan | 333/21 A |
| 61-264801 | 11/1986 | Japan | 333/21 A |
| 62-127103 | 8/1987 | Japan . | |
| 63-178901 | 11/1988 | Japan . | |
| 179001 | 7/1990 | Japan | 333/21 A |
| 4373201 | 12/1992 | Japan | 333/21 A |
| 5029801 | 2/1993 | Japan | 333/21 A |

OTHER PUBLICATIONS

Design Method for Circular Polarizer Using Waveguide Partially Filled with Conducting Wedge, T. Kaneki et al., Electronics and Communications in Japan, vol. 61–B, No. 12, (1978), pp. 66–73, no month.

*Primary Examiner*—Benny Lee
*Attorney, Agent, or Firm*—Ratner & Prestia

[57] ABSTRACT

A circular-linear polarizer includes a waveguide and a one quarter wave length plate which is installed on the inside wall of the waveguide. The surfaces of the waveguide and the one-quarter wave length plate forming the junction between them are flat. Alternatively, the one quarter wave length plate has a mounting surface for mounting on the inside wall of the waveguide. The mounting surface has a circular cross section which is complementary to the circular inside cross section of the waveguide. The junction provides improved electrical contact between the waveguide and the one-quarter wavelength plate. In addition, the cross polarization and axial ratio of the waveguide are improved while maintaining good impedance characteristics.

3 Claims, 8 Drawing Sheets

CIRCULAR-LINEAR POLARIZER INCLUDING FLAT AND CURVED PORTIONS

FIELD OF THE INVENTION

The present invention relates to a circular-linear polarizer used for transmission or reception of microwave electromagnetic waves, and, more particularly, to a waveguide having a one quarter wave length plate.

BACKGROUND OF THE INVENTION

Circularly polarized electromagnetic waves which have a rotating electric field vector are widely used for the transmission in the microwave band because the antenna used is easy to set up.

FIGS. 16(*a*) and 16(*b*) and FIG. 17 illustrate a circular-linear polarizer according to the prior art. FIGS. 16(*a*) and 16(*b*) are sectional views from the direction of the axis of the waveguide, the direction of the electromagnetic wave transmission. FIG. 17 is a side view along line 17—17. The prior art circular-linear polarizer has a hollow waveguide 6 having a circular section and a ¼ wave length phase plate 1 of metal for generating a phase difference of ¼ wave length. The phase plate 1 is attached to the inside surface 4 by screws 5. The ¼ wave length phase plate 1 is, as shown in FIG. 17, trapezoid with a specified thickness, and is mounted with the flat end surface on the inside of the waveguide, on the upper side as shown in FIGS. 16(*a*) and 16(*b*) by screws 5. In such a structure, however, as shown in the partially enlarged section of FIG. 16(*b*), the phase plate 1 and the circular inside surface 4 of the circular waveguide 6 make contact only at the two edges of the end surface of the plate. A gap is present between the two edges. As a result, a very small contact surface exists and incomplete grounding results, so that favorable input impedance characteristic or cross polarization characteristic are difficult to obtain.

In addition, small discrepancies in the position of the phase plate 1 causes considerable deterioration of the cross polarization characteristics, and difficulty in obtaining stable characteristics.

Alternatively, it is possible to make the circular-linear polarizer with a phase plate formed from dielectrics instead of metal. In this case, however, similar difficulties still arise in the exact positioning of the phase plate. The gap between the edges and small inaccuracies in positioning result in variation of characteristics. Thus, in the assembly process, adjustment of the mounting position of the phase plate is often necessary.

SUMMARY OF THE INVENTION

The present invention relates to a circular-linear polarizer comprising a phase plate mounted on a waveguide so that a large contact area without a gap is formed between the phase plate and the wave guide. As a result, improved cross polarization characteristics are realized while maintaining favorable impedance characteristics of the waveguide.

The present invention further relates to means for exactly installing the phase plate in its correct position to reduce the deterioration of cross polarization characteristics and to stabilize characteristics with reduced readjustment or reassembling.

A first embodiment of the circular-linear polarizer according to the present invention includes a waveguide and a one-quarter wave length plate. The waveguide has one inside surface section consisting of four circular parts and four linear parts arranged alternately. The circular parts have arches which are the same size and obtained from one circle. The linear parts have the same length. The one-quarter wave length plate is a metal trapezoid having a specified thickness.

The longer base of the trapezoid of the one-quarter wave length plate is installed on a flat part of the inside of the waveguide which corresponds to the linear part of the inside surface section to form a flat junction surface.

A second embodiment of the present invention relates to a circular-linear polarizer including a waveguide similar to the waveguides above and a one-quarter wave length plate made from a H-shaped dielectric. The two vertical lines of the H-shaped dielectric are arranged to correspond to two complementary facing flat parts inside the waveguide.

A third embodiment of the present invention relates to a circular-linear polarizer including a one-quarter wave length trapezoid shaped metal plate installed on the inside wall of the linear polarizer which has a circular shape. The long bottom of the trapezoid has a radius of curvature which corresponds to the radius of curvature of the inside wall of the waveguide where the one-quarter wave length metal plate is installed.

A fourth embodiment of the present invention relates to a circular-linear polarizer having a one-quarter wave length plate made of a H-shaped dielectric having two vertical lines. The two vertical lines have the same radius of curvature as an area where the two vertical lines form two junction surfaces with the inside wall of the waveguide.

A fifth embodiment of the present invention relates to a circular-linear polarizer of the first and third embodiments including a one-quarter wave length plate having a boss on the joining surface and a waveguide having a hole corresponding to and for receiving the boss.

Thus, the circular-linear polarizer of the present invention having the structure according to the first to the fourth embodiments have a large junction area but do not have a gap between the junction faces of the one-quarter wave length plate and the inside surface of the waveguide. As a result, improved cross polarization is realized while maintaining the input impedance characteristics of the waveguide circuit.

In addition, according to the fifth embodiment, the polarizer can reduce the deterioration of the cross polarization as a result of inaccurate positioning, keeping stable performance, and reducing problems with adjusting the exact position or reassembling the linear polarizer.

DETAILED DESCRIPTION OF THE INVENTION

Figure 1:
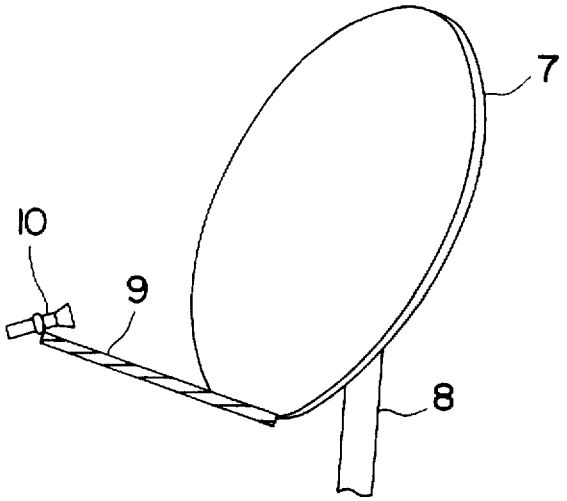
FIG. 1 is a perspective view of an antenna employing a circular-linear polarizer according to an exemplary embodiment of the present invention.

Referring to FIG. 1, a circular-linear polarizer according to an exemplary embodiment of the present invention is included in a converter 10 which is applied to a parabolic antenna 7 with an arm 9. A post 8 supports the parabolic antenna 7. A post 8 supports the parabolic antenna 7. The converter 10 comprises a waveguide circuit and a converter circuit (not shown). The waveguide has a circular-linear polarizer and a primary radiator.

Figure 2:
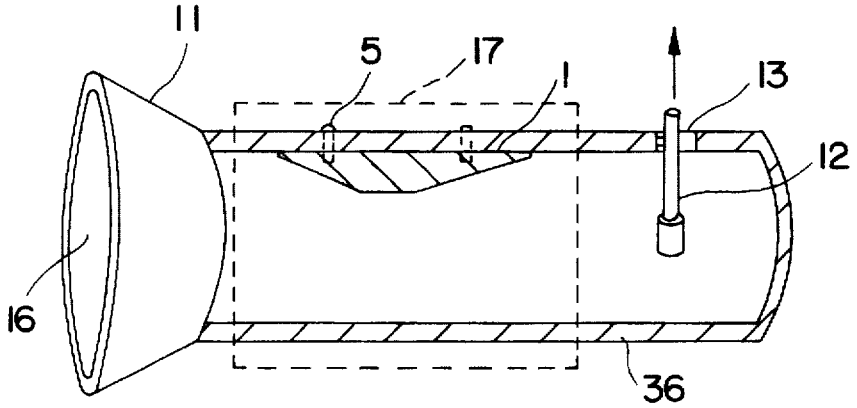
FIG. 2 is a fragmentary sectional view of a waveguide circuit constructed with a primary radiator and a circular-linear polarizer according to an exemplary embodiment of the present invention.

FIG. 2 shows the inside of the waveguide circuit of converter 10 which includes a primary radiator 11 with an opening 16, a waveguide 36, a part of waveguide 36 which forms a circular-linear polarizer 17, and an exciting probe 12 supported by an insulator 13 on the wall of the waveguide 36. A circularly polarized wave entering the opening 16 is converted by the circular-linear polarizer 17 into a linearly polarized wave. The linearly polarized wave is transmitted to a converter circuit through probe 12.

First Exemplary Embodiment

Figure 3A:
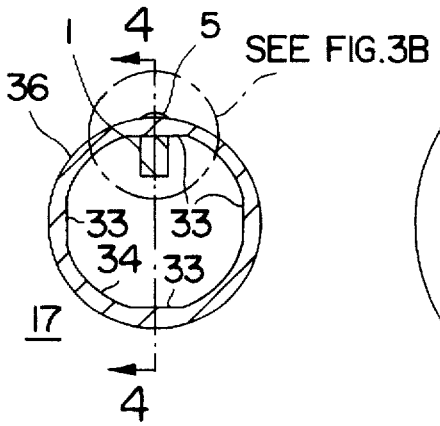
FIG. 3*a* is a cross sectional view of a circular-linear polarizer of a first exemplary embodiment of the present invention, viewed from the axis of the waveguide.

The first exemplary embodiment is discussed below with reference to FIG. 2, FIG. 3(*a*), FIG. 3(*b*), and FIG. 4. The outer surface of the waveguide 36 forms a circular cylinder, whereas a section of the inside surface of the waveguide includes four circular parts 34 and four linear parts 33 alternatively arranged as shown in FIGS. 3*a* and 3*b*. The lengths of the circular parts are the same, and the lengths of the linear parts are the same.

The section of the waveguide having the alternating linear and circular parts is the same length as the waveguide which extends from opening 16 to the other end. On one of the flat parts 33 a one-quarter wave length plate 1 of metal, for example, of aluminum, is fixed with two screws 5 as shown in FIG. 4. As shown in FIG. 4, the circular linear polarizer 17 includes a one-quarter wave length plate 1. The plate 1 is trapezoid with the longer base of the trapezoid attached to the flat part 33. The two non-parallel sides of the trapezoid extending from the ends of the base are formed at an incline to avoid the reflection of the incident waves. The plate has a specified thickness and the bottom surface la is flat so that gaps are not left between the bottom surface la and the flat part 33 of the waveguide inside.

The circular-linear polarizer described above synthesizes two linearly polarized elements with circularly polarized waves with 90° different phases. This is accomplished by changing the length of the wave with the λ/4 phase plate in the waveguide 36 to produce the phase difference corresponding to a fourth of the wave length.

Figure 3B:
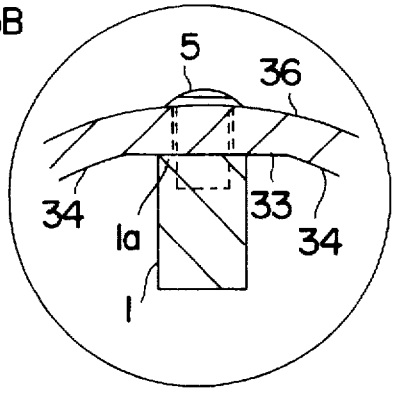
FIG. 3*b* is an exploded view of FIG. 3*a*.
Figure 4:
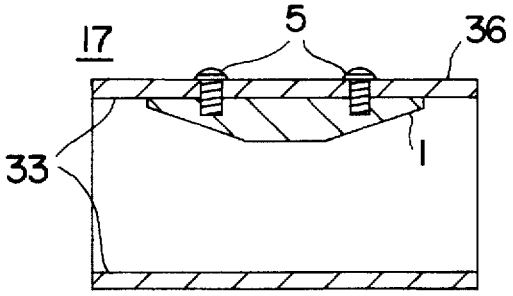
FIG. 4 is a side sectional view of the circular-linear polarizer along line 4—4 in FIG. 3*a*.

According to the circular-linear polarizer of the first exemplary embodiment, the flat junction surface 1*a* (as shown in FIG. 3*b*) of the λ/4 plate is joined to the flat part 33 of the wall of the waveguide, so that gaps are not left between the λ/4 plate and the flat part 33 and a large junction area with good grounding is obtained.

Second Exemplary Embodiment

Figure 9:
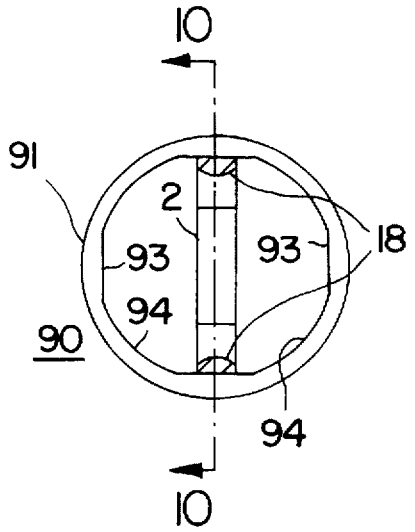
FIG. 9 is a cross sectional view of a waveguide viewed along the axis of the waveguide which is the same as the first embodiment except that the one-quarter wave length plate is formed from a dielectric or a λ/4 dielectric plate.
Figure 10:
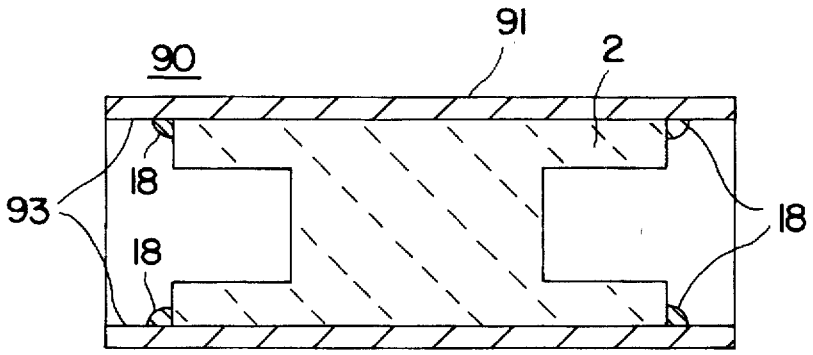
FIG. 10 is a longitudinal sectional view of the waveguide shown in FIG. 9 along line 10—10.

The second exemplary embodiment is explained with reference to FIG. 9 and FIG. 10. In the second embodiment a circular-linear polarizer 90 is formed by employing the wave-shortening effect of a dielectric which is the same as the first embodiment 1 except the waveguide 91 is provided with a dielectric plate 2. The wave guide includes flat parts 93 and circular parts 94 as shown in FIG. 9. The dielectric, for example, could be made of fluorocarbon polymers which bridge the opposing two flat parts 93 of waveguide 91. The plate 2 has a large rectangular notch along each side so that the length of plate 2 along the waveguide axis direction has a shorter inner surface and longer end surfaces which are adjacent to the inner surface of the waveguide as shown in FIG. 10. In other words, plate 2 has a H-shape with the two side bars of the H shape fixed on the inside of the waveguide. Plate 2 has a specified thickness and is fixed on the flat parts 93 of the waveguide with a binding agent 18 leaving no gaps. The H shape of plate 2 helps suppress the unfavorable effects caused by the reflection of the wave by the plate.

The notch, instead of being rectangular, may be triangular. In addition, the H-shaped plate also includes an H-shaped plate having two opposing sides having concave parts.

Third Exemplary Embodiment

Figure 11:
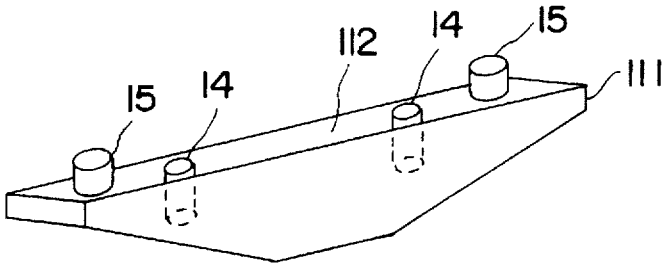
FIG. 11 is a perspective view of a λ/4 metal plate employed in the third embodiment.
Figure 12:
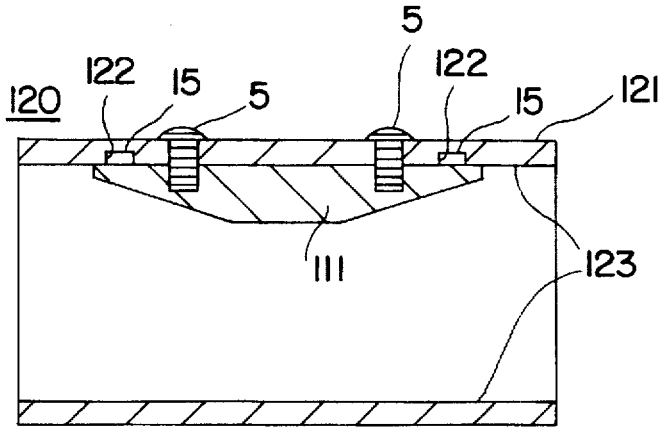
FIG. 12 is a cross-sectional view of a circular-linear polarizer constructed with the metal plate shown in FIG. 11.

FIG. 12 shows a circular linear polarizer 120. Referring to FIG. 11 and 12, the λ/4 metal plate 111 is, for example, aluminum and installed on the flat inside wall 123 of the waveguide 121 with screw 5 as shown in FIG. 12. Metal plate 111 includes a flat surface 122 (see FIG. 11) which contacts flat surface 123. As shown in FIG 11, holes 14 are provided in metal plate 111 for accepting screws 5 as shown in FIG. 12. Boss 15 on the λ/4 metal plate is coupled with the hole 122 (see FIG. 12) provided on the flat surface 123. Hole 122 can either pass entirely through flat surface 123 or be formed on flat surface 123 so that it does not pass entirely through flat surface 123.

As a result, the position of the phase plate is exactly controlled without variation, and the assembling process is easy and efficient.

Fourth Exemplary Embodiment

Figure 13:
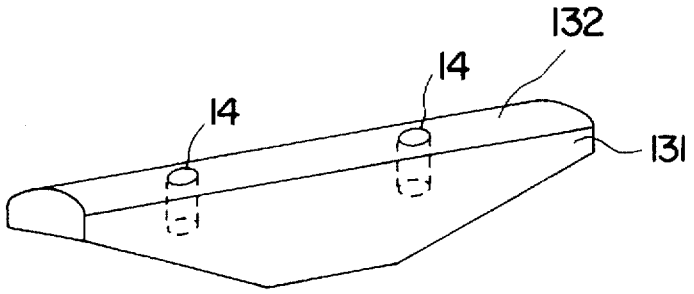
FIG. 13 is a perspective view of a λ/4 metal plate employed in the fourth exemplary embodiment.
Figure 14A:
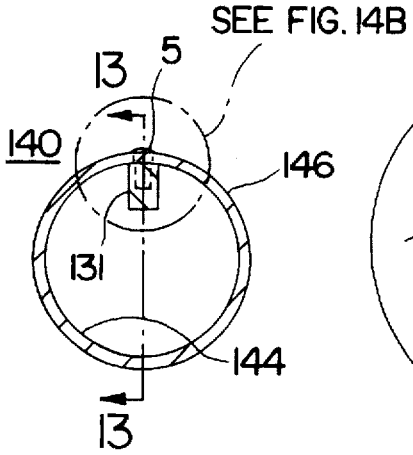
FIG. 14*a* is a cross sectional view of a circular-linear polarizer constructed with the λ/4 metal plate shown in FIG. 13 viewed from the axial direction.
Figure 14B:
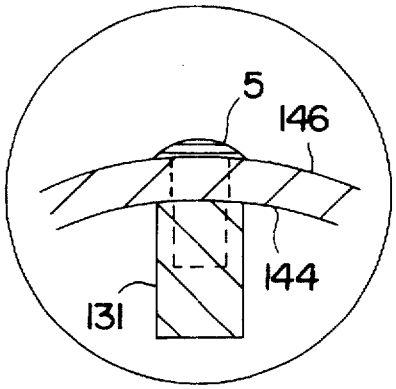
FIG. 14*b* is an exploded view of FIG. 14*a*.

FIG. 14*a* shows a circular linear polarizer 140. Referring to FIG. 13 and FIGS. 14(*a*) and 14(*b*), the waveguide 146 has a circular cross section 144 and a trapezoid λ/4 metal phase plate 131 with the junction side surface 132 (see FIG. 13) having the same radius of curvature as the inside wall of the waveguide. As a result, the junction between the waveguide 146 and the phase plate 131 may be made without a gap and sufficient contact area can be obtained. As shown in FIG. 13, the metal phase plate 131 includes holes 14 for accepting screws 5, one of which is shown in FIGS. 14*a* and 14*b*. Alternatively, instead of using the λ/4 metal phase plate, a H shape dielectric plate as shown in FIG. 10 having sufficient contact between the dielectric plate and the inside wall of the waveguide can be used.

Fifth Exemplary Embodiment

Figure 15:
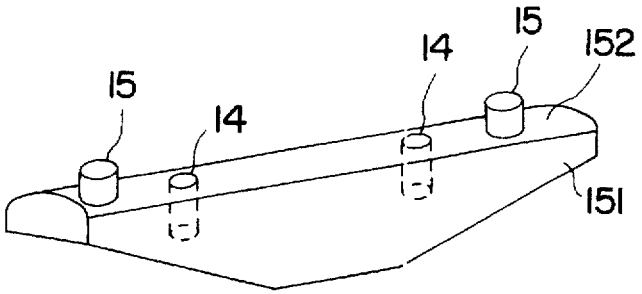
FIG. 15 is a perspective view of a λ/4 metal plate employed in the fifth exemplary embodiment.
Figure 16A:
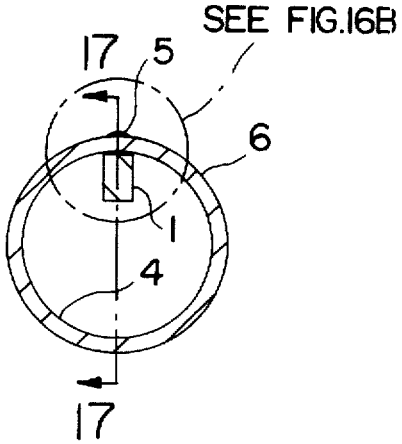
FIG. 16A PRIOR ART
FIG. 16*a* is a cross sectional view of a circular-linear polarizer constructed with a conventional waveguide and a metal plate viewed from the axial direction.
Figure 16B:
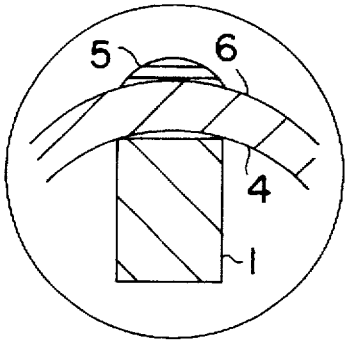
FIG. 16B PRIOR ART
FIG. 16*b* is an exploded view of FIG. 16*a*.
Figure 17:
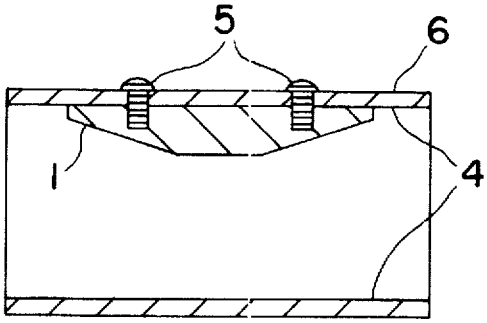
FIG. 17 PRIOR ART
FIG. 17 is a sectional view of the circular-linear polarizer shown in FIG. 16*a* along line 17—17.

Referring to FIG. 15, the phase plate 151 is provided with a junction base surface 152 having the same radius of curvature as the inside wall of the waveguide and a boss 15 which is coupled with a hole in the waveguide wall. The phase plate 151 includes holes 14 for accepting screws 5.

Figure 5:
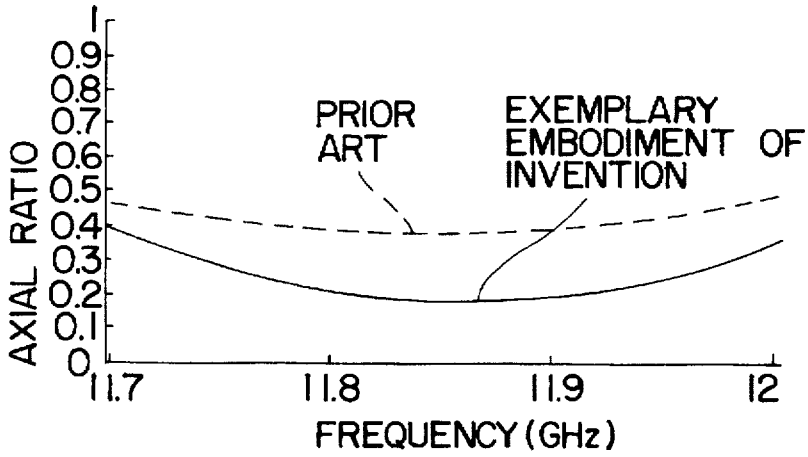
FIG. 5 is a graph illustrating the variation of the axial ratio against input frequency of the circular-linear polarizer of the first embodiment.

In FIG. 5, the axial ratio of the circular-linear polarizer of Embodiment 1 and the prior art versus the input frequency over the range of 11.7 to 12.0 GHz is shown. The axial ratio indicates the ratio of the short axis to the long axis of the ellipse of the polarized wave. If the ratio is close to 1 or 0 dB, the ellipse of the polarization is close to a circle. FIG. 5 illustrates the improvement in axial ratio of the polarizer of Embodiment 1.

The impedance characteristics of the first embodiment were favorable keeping the reflection wave below −23 dB to the incident wave over the frequency range.

Figure 6:
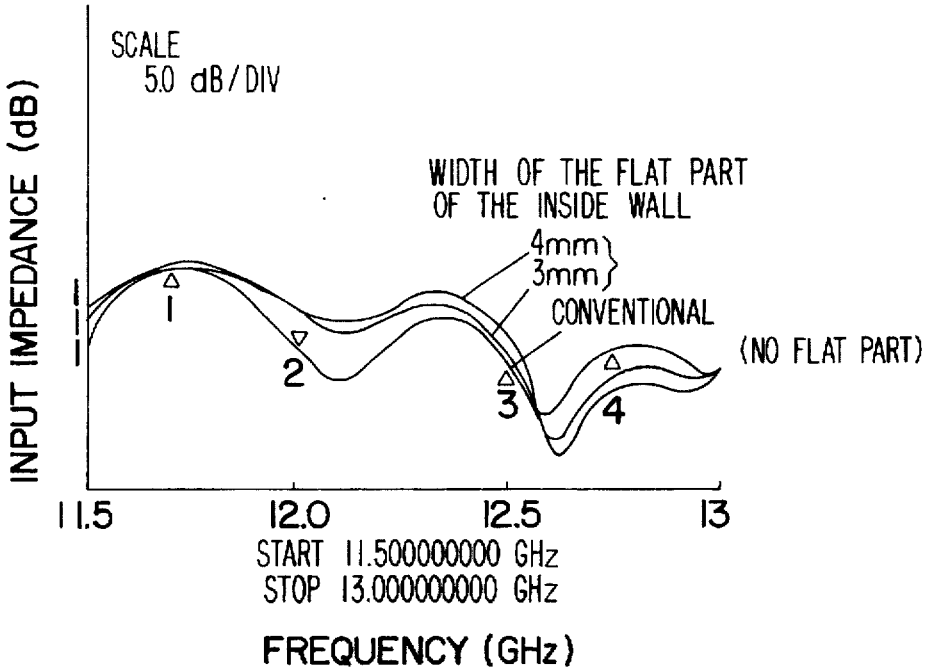
FIG. 6 is a graph illustrating the variation of the input impedance of the circular-linear polarizer of the first exemplary embodiment against the input frequency where the width of the flat part of the waveguide is varied.

In FIG. 6, variation of the input impedance of the first embodiment for various input frequencies for different widths of the flat part of the waveguide is shown.

It is observed that the input impedance of the waveguide of the first and second embodiments having a flat part of 3 to 4 mm in width was nearly the same as the prior-art circular waveguide. The input impedance did not change appreciably over 360° around the waveguide axis illustrating that the flat parts did not degenerate the axial ratio of the waveguide. As a result, even without the λ/4 phase plate, a linearly polarized wave can be transmitted or received with favorable cross polarization.

The frequency ranges in FIG. 6 between marks 1 and 2, and between marks 3 and 4 show the BS broadcasting band and the CS broadcasting band respectively.

Figure 7:
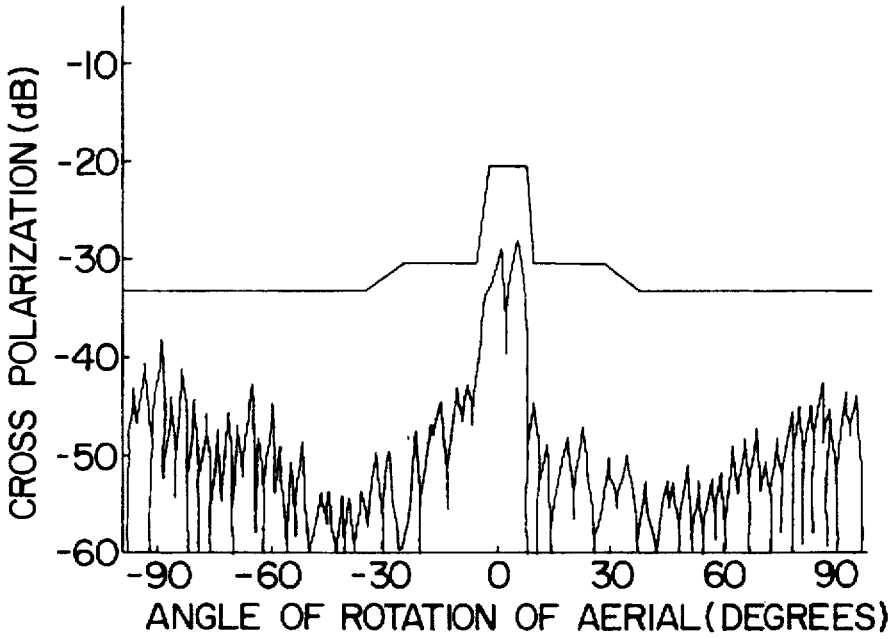
FIG. 7 is a graph of the cross polarization characteristic of an antenna constructed with the circular-linear polarizer of the first exemplary embodiment against the angle of rotation of the antenna.
Figure 8:
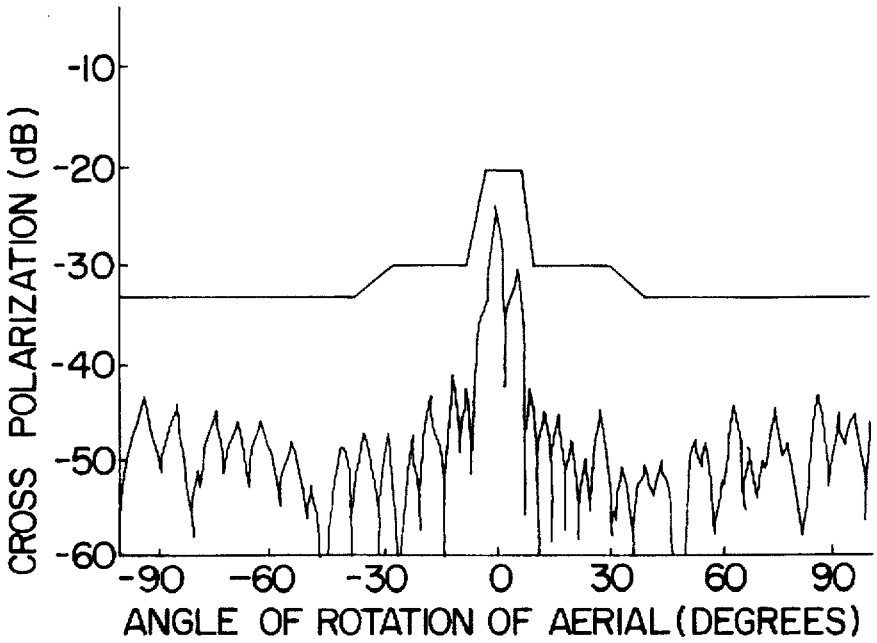
FIG. 8 PRIOR ART
FIG. 8 is a graph of the cross polarization characteristic of an antenna constructed with the prior art circular-linear polarizer.

FIG. 7 illustrates a cross polarization of the circular-linear polarizer of first embodiment combined with a parabolic antenna of 45 cm diameter as shown in FIG. 1 rotated around the antenna supporting axis over a range of plus or minus (±) 90° at the input frequency 11.85 GHz. The cross polarization on the ordinate is shown as a relative value normalized with respect to the level obtained at an optimum condition of maximum receiving power for a co-polarized wave, right handed circularly polarized wave. FIG. 8 illustrates the cross polarization of the prior-art circular-linear polarizer under the same condition as the first embodiment illustrated in FIG. 7. Comparing the two figures, it is observed that the cross polarization is improved about 4 dB in the vicinity of the main lobe, bore sight, of the antenna radiation pattern for the first embodiment. The jagged lines in FIG. 7 and FIG. 8 are the CPZ-302 cross polarization curve which is a standard curve defined by Electronics Industrial Association of Japan.

The circular-linear polarizer according to the present invention, can prevent the deterioration of cross polarization due to inexact installation of the one quarter wave length plate. As a result, readjustments are not required, thus, improving productivity.

Thus, the circular-linear polarizer according to an exemplary embodiment of the present invention can be produced having a flat part with a specified width on the inside wall of the waveguide which does not have a gap between the wall and the phase plate. Accordingly, sufficient contact area can be obtained improving cross polarization while maintaining good input impedance. Cross polarization is the ability to exclude not-normally polarized waves.

Furthermore, the present invention by providing a boss and a hole at the junction surface between the waveguide and the phase plate as illustrated in Embodiment 3, prevents deterioration in the performance of the waveguide due to inexactness in assembly. As a result, assembly is made easier, requiring no adjustments. Accordingly, productivity is improved.

The flat parts used on the inside wall of the first and second embodiments do not deteriorate the impedance characteristic and axial ratio of the waveguide provided the width of the flat parts is appropriate, for example, 3 to 4 mm. A waveguide according to the above configuration without a one-quarter wave length plate shows favorable cross polarization discrimination for transmission and reception of a linearly polarized wave.

In addition, the waveguide according to the present invention has a structure which prevents the rotation of an interposed article, so that it is convenient to include a circuit part in the waveguide such as a ferrofeed for receiving linearly polarized waves orthogonal to each other.

As illustrated in the fourth embodiment, a junction surface of the phase plate having a similar shape to the inside wall of the waveguide can eliminate gaps and improving the connection between the waveguide and the phase plate. As a result, cross polarization can be improved while keeping a favorable input impedance.

Furthermore, as illustrated in the fifth embodiment, by providing a boss and a hole to receive the boss on the phase plate and the waveguide, deterioration in the performance, such as the axial ratio, in the waveguide due to inexact assembly may be reduced. Accordingly, stable operation and easy assembly can be obtained.

What is claimed:

1. A circular-linear polarizer comprising:

a waveguide having a cylindrical inner surface, said inner surface containing four curved portions which alternate between four substantially flat portions, at least one of said four substantially flat portions defining a joining surface; and a one-quarter wave length plate having a substantially flat joining face coupled to said joining surface, wherein, each of said four curved portions a) extends without interruption between every point on a respective edge of an adjacent two of said four flat portions, b) extends along all of a length of each of said adjacent two flat portions; and c) is completely closed and without an opening;

wherein each of said four substantially flat portions has a respective width which does not deteriorate the impedance characteristic of the waveguide.

2. A circular-linear polarizer according to claim 1, wherein the respective width of each said substantially flat portion is in the range of 3 mm to 4 mm.

3. A circular linear polarizer according to claim 1, wherein each of said four substantially flat portions respectively includes a first edge and a second edge, said first edge of one of said four substantially flat portions and said second edge of a further one of said four substantially flat portions are adjacent a first edge and a second edge, respectively, of one of said four curved portions.

* * * * *